US009894432B2

(12) United States Patent
Blore et al.

(10) Patent No.: US 9,894,432 B2
(45) Date of Patent: Feb. 13, 2018

(54) MODULAR ACOUSTIC HORNS AND HORN ARRAYS

(71) Applicant: Bose Corporation, Framingham, MA (US)

(72) Inventors: David Edwards Blore, Westborough, MA (US); Paul F. Fidlin, Wayland, MA (US); Soichiro Hayashi, Tokyo (JP); Thomas E. MacDonald, Boston, MA (US); Peter C. Santoro, Groton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/255,358

(22) Filed: Sep. 2, 2016

(65) Prior Publication Data

US 2016/0373856 A1 Dec. 22, 2016

Related U.S. Application Data

(63) Continuation of application No. 14/565,843, filed on Dec. 10, 2014, now abandoned.

(51) Int. Cl.

| | |
|---|---|
| ***H04R 1/02*** | (2006.01) |
| ***H04R 1/20*** | (2006.01) |
| ***H04R 1/30*** | (2006.01) |
| ***G10K 11/02*** | (2006.01) |
| ***H04R 1/40*** | (2006.01) |

(Continued)

(52) U.S. Cl.

CPC ..... *H04R 1/30* (2013.01); *G10K 11/025* (2013.01); *G10K 11/26* (2013.01); *H04R 1/345* (2013.01); *H04R 1/403* (2013.01); *H04R 2400/13* (2013.01); *Y10T 29/49575* (2015.01)

(58) Field of Classification Search

CPC ..... H04R 1/403; H04R 1/30; H04R 2400/13; G10K 11/025; G10K 11/26; Y10T 29/49575

USPC ..... 381/342

See application file for complete search history.

(56) References Cited

U.S. PATENT DOCUMENTS 6,394,223 B1 * 5/2002 Lehman ..... H04R 1/345 181/152

FOREIGN PATENT DOCUMENTS

EP 1816898 A2 8/2007

OTHER PUBLICATIONS

European Office Action dated Mar. 1, 2017 for European Patent Application No. 10744826.8.

(Continued)

*Primary Examiner* — Paul S Kim

(74) *Attorney, Agent, or Firm* — Bose Corporation

(57) ABSTRACT

A modular horn type loudspeaker and a modular horn array formed of modular loudspeakers. An acoustic horn includes a first acoustic module. The first acoustic module includes a first acoustic driver and a first acoustic duct, for conducting acoustic energy from the first acoustic driver. The first acoustic duct has a first opening through which acoustic energy is radiated. The first acoustic duct is characterized by a first centerline. A second acoustic module includes a second acoustic driver and a second acoustic duct, for conducting acoustic energy from the acoustic driver. The second acoustic duct has a second opening through which acoustic energy is radiated. The second acoustic duct is characterized by a second centerline.

24 Claims, 14 Drawing Sheets

(51) Int. Cl.
*G10K 11/26* (2006.01)
*H04R 1/34* (2006.01)

(56) References Cited

OTHER PUBLICATIONS

European Office Action dated Mar. 9, 2017 for European Patent Application No. 12156119.5.

* cited by examiner

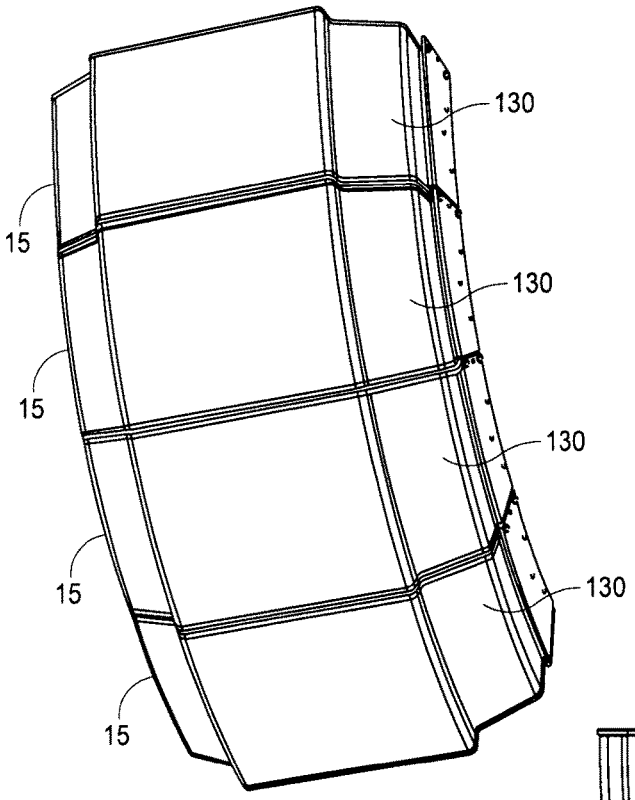
FIG. 3
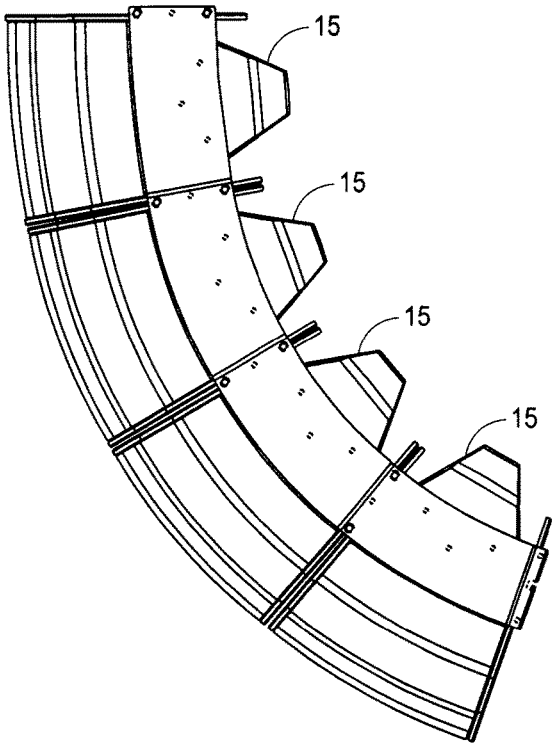

MODULAR ACOUSTIC HORNS AND HORN ARRAYS

This application is a continuation of, and claims priority to, U.S. patent application Ser. No. 14/565,843 filed Dec. 10, 2014 (having the same title and inventors as the instant application), which is a continuation of, and claims priority to, U.S. patent application Ser. No. 12/898,947 filed Oct. 6, 2010 (having the same title and inventors as the instant application), which is a continuation-in-part of, and claims priority to, U.S. patent application Ser. No. 12/557,885 filed Sep. 11, 2009, by Ickler, et al. and titled "Automated Customization of Loudspeakers", all of which are incorporated by reference in their entirety.

BACKGROUND

This specification describes a modular horn type loudspeaker and horn loudspeaker arrays formed with modular horn type loudspeakers.

SUMMARY

In one aspect, an apparatus includes a first acoustic horn. The first acoustic horn includes a first acoustic module. The first acoustic module includes a first acoustic driver and a first acoustic duct, for conducting acoustic energy from the first acoustic driver. The first acoustic duct has a first opening through which acoustic energy is radiated. The first acoustic duct is characterized by a first centerline. The apparatus also includes a second acoustic module. The second module includes a second acoustic driver and a second acoustic duct, for conducting acoustic energy from the acoustic driver. The second acoustic duct has a second opening through which acoustic energy is radiated. The second acoustic duct is characterized by a second centerline. The first module and the second module are configured to be positioned and held in place so that the first and second openings are aligned to form a substantially continuous diffraction slot and so that the first and second centerlines are normal to an arc and intersect at a first one of a plurality of angles. The apparatus may include an additional plurality of acoustic modules. Each of the additional acoustic modules may include an acoustic driver and an acoustic duct. Each duct may include an opening through which acoustic energy is radiated. Each duct may be characterized by a centerline. Each of the additional plurality of acoustic modules may be configured to be positioned and held in place so that the opening of each of the additional plurality of acoustic modules is aligned with the openings of the others of the plurality of acoustic modules and with the openings of the first and second acoustic modules to form a substantially continuous diffraction slot. The first module, the second module, and the plurality of additional modules may be substantially identical. The additional plurality of acoustic modules may be configured to be positioned and held in place so that the centerlines of the additional plurality of modules intersect at the one angle of the plurality of angles. The first module and the second module may be substantially identical. The first module and the second module may be asymmetric about at least one axis, and wherein the first module may be oriented so that the first module is rotated 180 degrees about the axis relative to the second module. The plane of the first opening and the second opening may intersect at a first angle, and the apparatus may further includes a second acoustic horn. The second acoustic horn may include a third acoustic module. The third acoustic module may include a third acoustic driver and a third acoustic duct, for conducting acoustic energy from the third acoustic driver. The third acoustic duct may have a third opening through which acoustic energy is radiated. The third acoustic module may be characterized by a third centerline. The second acoustic horn may include a fourth acoustic module. The fourth acoustic module may include a fourth acoustic driver; and a fourth acoustic duct, for conducting acoustic energy from the acoustic driver. The fourth acoustic duct may have a fourth opening through which acoustic energy is radiated. The fourth acoustic duct may be characterized by a fourth centerline. The third module and the fourth module may be configured to be positioned and held in place so that the third and fourth openings are aligned to form a substantially continuous diffraction slot and so that the third centerline and the fourth centerline are normal to an arc and so that the third and fourth centerline intersect at a second angle, different from the first angle. The first acoustic horn and the second acoustic horn may be arranged so that the first horn diffraction slot and the second horn diffraction slot are aligned to form a combined diffraction slot with no gap substantially larger than the combined thickness of a top of one of the acoustic horns and the bottom of the other of the acoustic horns. The first module, the second module, the third module and the fourth module may be substantially identical. The first acoustic horn may further include a top and a bottom. The apparatus may be configured so that the top and bottom used when the centerlines intersect at the first of the plurality of angles is the same as when the centerlines intersect at another of the plurality of angles.

In another aspect, an apparatus includes a first acoustic horn. The first acoustic horn includes a first acoustic module. The first acoustic module includes a first acoustic driver; and a first acoustic duct, for conducting acoustic energy from the first acoustic driver. The first acoustic duct has a first elongated planar opening through which acoustic energy is radiated. The apparatus further includes a second acoustic module. The second acoustic module may include a second acoustic driver and a second acoustic duct, for conducting acoustic energy from the acoustic driver. The second acoustic duct may have a second elongated planar opening through which acoustic energy is radiated. The first module and the second module may be configured to be positioned so that the first and second elongated planar openings are aligned in the direction of elongation to form a substantially continuous diffraction slot and so that the plane of the first elongated planar opening intersect the plane of the second elongated planar opening at any one of a plurality of angles. The apparatus further includes a bracket to hold the acoustic modules in a desired position and orientation. The apparatus may further include an additional plurality of acoustic modules. Each of the additional acoustic modules may include an acoustic driver and an acoustic duct. Each duct may have an elongated planar opening through which acoustic energy is radiated. Each of the additional plurality of acoustic modules may be configured to be positioned so that the opening of each of the additional plurality of acoustic modules is aligned in the direction of elongation with the openings of the others of the plurality of acoustic modules and with the openings of the first and second acoustic modules to form a substantially continuous diffraction slot. The first module, the second module, and the plurality of additional modules may be substantially identical. The additional plurality of acoustic modules may be configured to be positioned so that the plane of the elongated opening intersects with the plane of the elongated opening of an adjacent acoustic module at the one of the plurality of angles. The first module and the second module may be substantially identical. The first module and the second module may be asymmetric about at least one axis and the first module may be oriented so that the first module is rotated 180 degrees about the axis relative to the second module. The plane of the first elongated planar opening and the plane of the second elongated planar opening may intersect at a first one of the plurality of angles. The apparatus may further include a second acoustic horn. The second acoustic horn may include a third acoustic module. The third acoustic module may include a third acoustic driver and a third acoustic duct, for conducting acoustic energy from the third acoustic driver. The third acoustic duct may have a third elongated planar opening through which acoustic energy is radiated. The apparatus may include a fourth acoustic module includes a fourth acoustic driver and a fourth acoustic duct, for conducting acoustic energy from the acoustic driver. The fourth acoustic duct may have a fourth elongated planar opening through which acoustic energy is radiated. The third module and the fourth module may be configured to be positioned so that the third and fourth openings are aligned in the direction of elongation to form a substantially continuous diffraction slot and so that the plane of the third elongated planar intersects the plane of the fourth elongated planar opening at a second one of the plurality of angles, different from the first one of the plurality of angles. The first acoustic horn and the second acoustic horn may be arranged so that the first horn diffraction slot and the second horn diffraction slot are aligned to form a combined diffraction slot with no gap substantially larger than the combined thickness of a top of one of the acoustic horns and the bottom of the other of the acoustic horns. The first module, the second module, the third module and the fourth module may be substantially identical. The apparatus may further include a top a bottom. The apparatus may be configured so that the top and the bottom used when the planes intersect at the one of the plurality of angles can be used when the planes intersect at a second one of the plurality of angles.

In another aspect, a method for forming loudspeaker arrays, includes providing at least two acoustic horns from a first plurality of acoustic horns each of the plurality of acoustic horns having a top having a planar top surface and a bottom having a planar bottom surface. The top and the bottom are characterized by a thickness. Each of the plurality of horns has a different vertical dispersion angle. Each horn includes a diffraction slot. The method further includes arranging the plurality so that a top surface of one acoustic horn is parallel to, and in planar contact with, the bottom surface of an adjacent acoustic horn. The horn diffraction slots are aligned to form an array diffraction slot with gaps not substantially larger than the combined thickness of the top of the one horn and the bottom of the adjacent acoustic horn. The providing may include forming a first of the acoustic horns from a first plurality of substantially identical acoustic modules. Each module may include an acoustic driver and an acoustic duct having an opening. Each acoustic duct may be characterized by a centerline. The forming may include arranging the first plurality of acoustic modules so that the centerlines are normal to a first arc and intersect at an angle and so that the openings are aligned to form the first acoustic horn diffraction slot. The method may further include forming a second of the acoustic horns from a second plurality of acoustic modules, substantially identical to the first plurality of acoustic modules. Each module may include an acoustic driver and an acoustic duct having an opening. Each acoustic duct may be characterized by a centerline. The forming may include arranging the second plurality of acoustic modules so that the centerlines are normal to a second arc and so that the openings are aligned to form the second acoustic horn diffraction slot. The forming of the first of the acoustic horns may further include arranging the first plurality of acoustic modules so that the centerlines intersect at a first one of a plurality of angles. The forming of the second of the acoustic horns may include arranging the second plurality of acoustic modules so that the centerlines intersect at a second one of the plurality of angles, different from the first one of the plurality of angles.

Other features, objects, and advantages will become apparent from the following detailed description, when read in connection with the following drawing, in which:

BRIEF DESCRIPTION OF THE SEVERAL VIEWS OF THE DRAWING

FIG. 3 includes two views of an acoustic horn array;

FIGS. 4-8A are diagrammatic side views of acoustic horns and horn arrays, illustrating various aspects of the horns;

DETAILED DESCRIPTION

Figure 1:
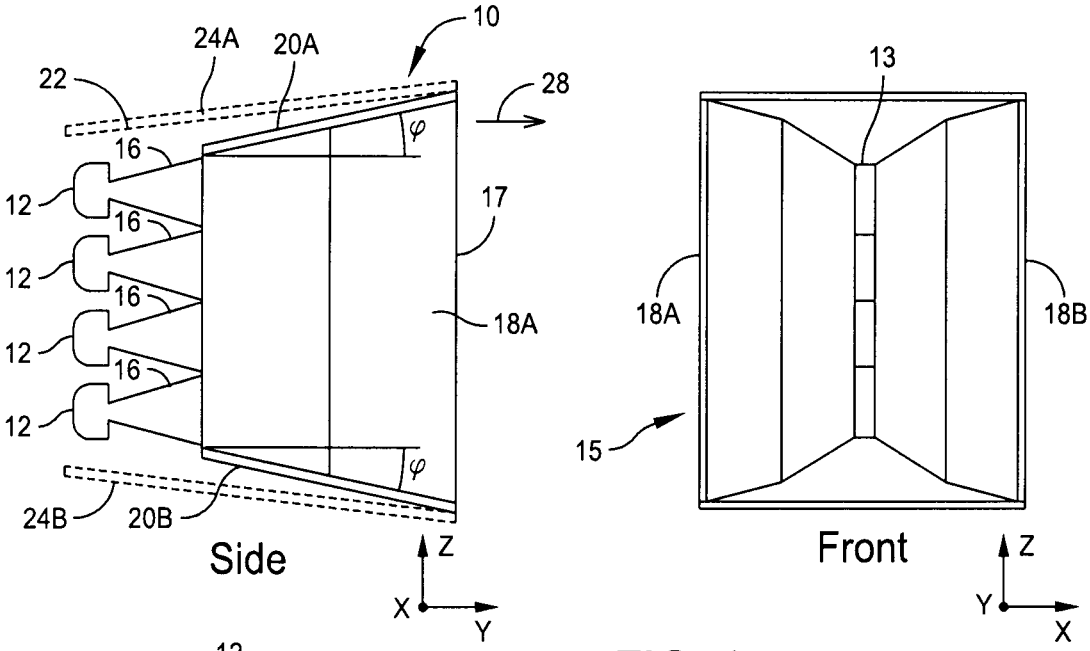
FIG. 1 includes three diagrammatic plans views of an acoustic horn.

FIG. 1 shows a horn type loudspeaker 10 for explaining some of the terms that are used in this specification. In the explanations that follow, a coordinate system will be used. The direction of intended radiation, indicated by arrow 28, is along the Y-axis. The X-axis is horizontal relative to the loudspeaker in the orientation of FIG. 1, and perpendicular to the Y-axis, and the Z-axis is vertical and perpendicular to the plane defined by the Y-axis and the X-axis. "Forward" and "front" etc. will refer to a location or direction in the + direction along the Y-axis. "Backward", "rear" and "behind"

etc. will refer to a location or direction in the – direction along the Y-axis. "Leftward" and "Left", etc. will refer to the – direction along the X-axis. "Rightward" and "Right", etc. will refer to the + direction along the X-axis. "Above" or "upward" will refer to the + direction along the Z-axis and "below" or "downward" will refer to the – direction along the Z-axis. "Width" refers to the dimension along the X-axis, "height" refers to the dimension along the Z-axis, and "depth" refers to the dimension along the Y-axis. The axes are defined relative to the horn loudspeaker, regardless of the orientation of the horn loudspeaker in space.

FIG. 1 is a diagrammatic view of a horn loudspeaker 10. A plurality, in this example four, of acoustic drivers 12 are acoustically coupled to the throat 13 of an acoustic horn 15 by acoustic ducts 16. The duct outlet end (that is, the end of the duct that is acoustically coupled to the throat) may be mechanically coupled to the throat 13 directly. Alternatively, the outlet ends of the ducts may be combined into a manifold which is acoustically coupled to the throat 13. The outlet ends of the ducts may be elongated. The elongated outlet openings of the acoustic ducts or the outlet of the manifold may be aligned in the direction of elongation at the throat to form a diffraction slot. The acoustic horn 15 includes horn side walls 18A and 18B and top and bottom walls 20A and 20B. In order to show details of the side walls 18A and 18B, top and bottom walls 20A and 20B are not shown in the top view. The side walls 18A and 18B flare outwardly. In some implementations, the walls may flare outwardly linearly. In other implementations, such as the implementation of FIG. 1, the side walls 18A and 18B can have two planar sections, a first planar section 21A and 21B flaring linearly outwardly at one rate and a second planar section 23A and 23B flaring outwardly linearly at a different rate. In other implementations, the horn walls make have a different geometry. For example, the walls may flare linearly or curve outwardly according to a continuous curve, such as an exponential curve or conic curve. Additionally, the side walls may flare out asymmetrically. The top and bottom walls 20A and 20B may be flared down and up, respectively, from the mouth 17 at an angle $\theta$ so that the vertical dispersion angle is $2\theta$. The horn may be partially enclosed in an enclosure 22, shown in dotted line in the side view only. For reasons that will be described below, the top wall 24A and the bottom wall 24B may be non-parallel with each other and with the top and bottom 20A and 20B of the horn, respectively. The acoustic drivers 12 and the ducts 16 will be discussed in more detail below. The enclosure 22 may have side walls or a back wall, but they are not germane to this application and are not shown in the figures.

In operation, the acoustic drivers transduce electrical energy into acoustic energy, which is conducted to the acoustic horn. The acoustic energy enters the acoustic horn at the throat 13 and exits the horn at the mouth 17 in a controlled and predictable radiation pattern.

Figure 2:
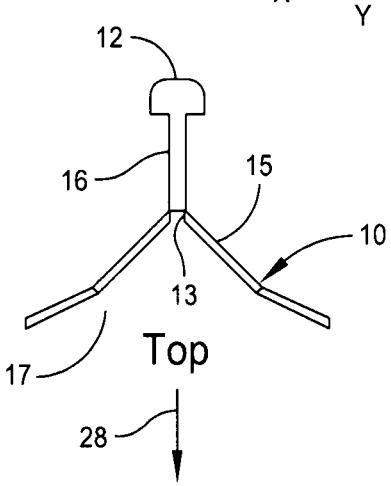
FIG. 2 is a diagrammatic oblique isometric view of an acoustic duct.
Figure 2:
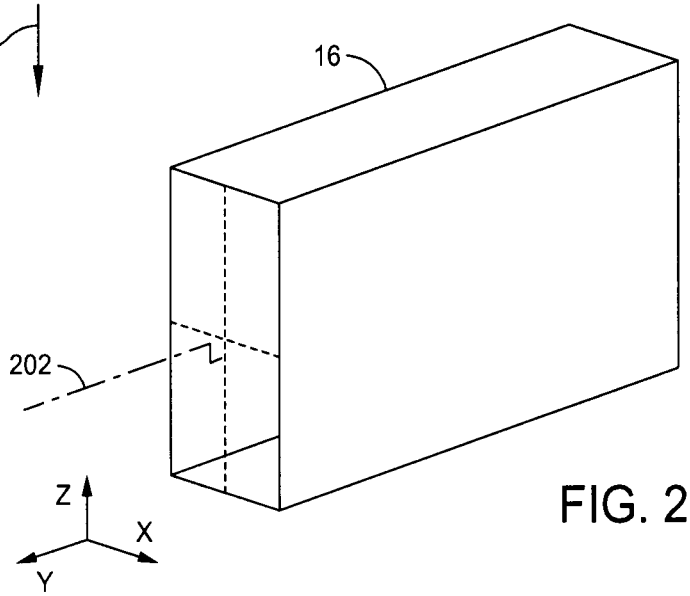

FIG. 2 is a diagrammatic view of an acoustic duct 16 for the purpose of explaining some terms used in the specification. The duct 16 may be characterized by a centerline 202 that passes through the geometric center of the duct opening and is perpendicular to the opening at the geometric center. In some implementations, the duct opening is substantially planar, so that the centerline 202 is perpendicular to the plane of the duct opening. In FIG. 2, the duct 16 is shown as straight and symmetric, but in an actual implementation, it may be curved and asymmetric about one or more axes.

It is desirable to use horns to radiate a full range of frequencies, including high frequencies, and to radiate the acoustic energy, particularly the high frequency acoustic energy, in a controlled and predictable radiation pattern. However, at high frequencies, with corresponding wavelengths that are less than the diameter of the acoustic driver, the individual acoustic drivers may exhibit radiation patterns that make it difficult to predict and control the radiation pattern of the horn loudspeaker. Using small diameter acoustic drivers is impractical, because radiating the sound pressure levels required of horn type loudspeakers would require a very large number of acoustic drivers. One frequently used element to radiate high amplitudes of high frequency acoustic energy is a diffraction slot.

In horn loudspeaker with a diffraction slot, the high frequency radiation is radiated by an acoustic driver and passes through an elongated diffraction slot, in some implementations via an intervening acoustic duct. The elongated slot may have, for example, a height of 34.3 cm (13.5 inches) and a width of, for example, 1.91 cm (0.75 inches), so the height is about 18 times the width. The diffraction slot diffracts the sound waves so that, in the horizontal direction, the sound waves behave as if they were radiated by an acoustic driver with a diameter of about the width of the diffraction slot, in this case 1.91 cm. A wavelength of 1.91 cm corresponds with a frequency of approximately 18 kHz.

To radiate high frequencies, horn type loudspeakers frequently use compression drivers and phase plugs. One suitable type of compression driver and phase plug arrangement is described in Wendell et. al. "Electroacoustic Transducing with Bridged Phase Plug", U.S. patent application Ser. No. 12/490,463, incorporated herein by reference in its entirety. In one implementation, the acoustic driver has a dome size of 5.1 cm (2 inches) is enclosed in an enclosure with and outside diameter of, for example, 10.2 cm (four inches) and radiates into a phase plug with an exit diameter of 2.5 cm (1 inch). This combination of acoustic drivers, phase plugs, and diffraction slot dimensions permits the radiation of high amplitudes of high frequency acoustic energy with a practical number of acoustic drivers.

Horn type loudspeakers are often used in audio systems for large venues, such as large sports arenas or outdoor venues, where it is necessary to radiate acoustic energy over large distances to large areas. Frequently the total amount of acoustic energy that must be radiated is more than a single horn type loudspeaker can radiate. In addition, frequently the area to which sound is to be radiated is too large to practically radiate from a single horn loudspeaker. In such situations a plurality of horn type loudspeakers may be arrayed. One common arrangement is a "J" shaped configuration as shown in FIG. 3. The horn loudspeakers of an array may have a grille 130 covering the front of the horn for cosmetic purposes or to protect the horn from damage. In a "J" shaped arrangement, it is desirable for the individual horns to be arranged so that the diffraction slots are aligned. It is desirable to minimize the separation between the diffraction slots of adjacent horn loudspeakers in the array, or, in other words, to minimize the distance between the top end of the diffraction slot of one horn loudspeaker and the bottom end of the diffraction slot of the next horn loudspeaker above it in the array.

Figure 4:
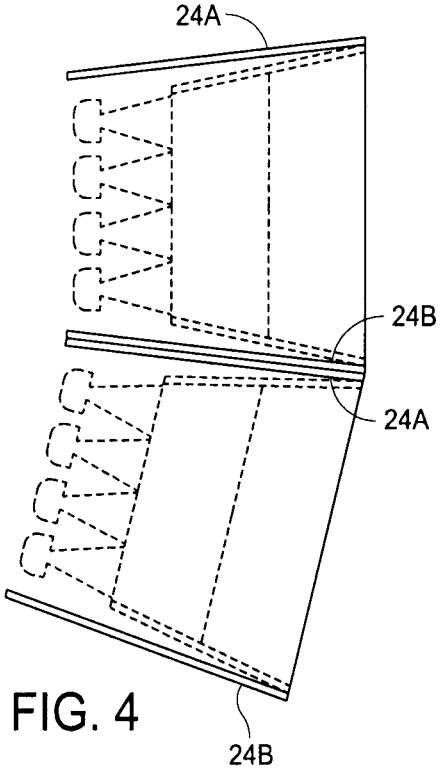
Figure 5:
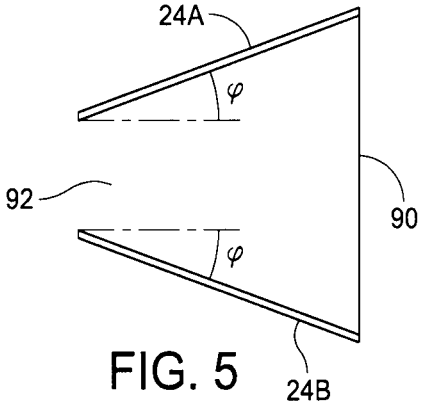
Figure 6:
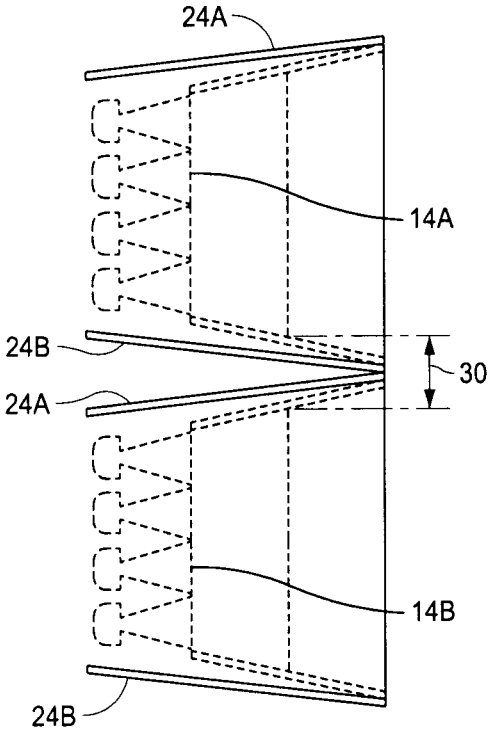
Figure 7:
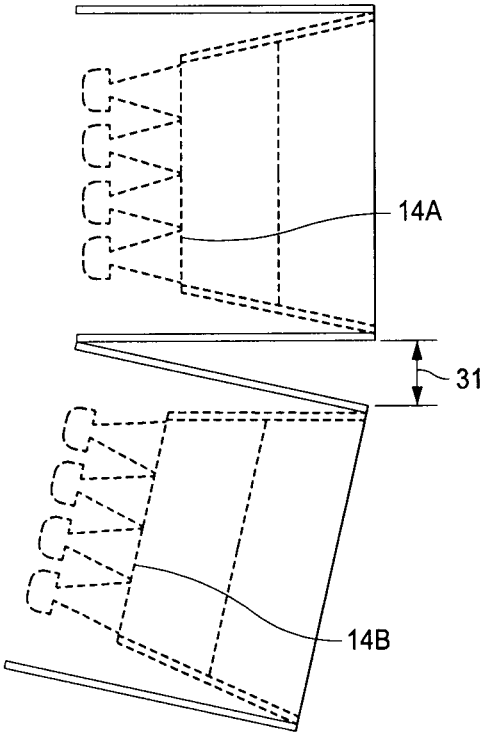

As best seen in FIG. 5, the top 24A and bottom 24B of the enclosure may be configured so that the height of the enclosure at the front 90 is greater that the height at the back 92 to permit the horns to be stacked at angle, as shown in FIG. 4. A typical angle $\varphi$ (greatly exaggerated in FIG. 5) is five degrees. For clarity, the acoustic drivers 12, the acoustic ducts 16, and the throat 13 are omitted in FIG. 5 If the horns are stacked so that they are not angled (e.g. at the straight part of the "J"), the top of one horn may be non-coplanar with the bottom of the horn above, as shown in FIG. 6. If the plane of the bottom 24B of the enclosure is non-parallel with the plane of the horn bottom 20A, there is a gap 30 between the top edge of the diffraction slot 14A of one horn loudspeaker and the bottom edge of the diffraction slot of the loudspeaker above in the array because the diffraction slot does not extend the entire height of the horn loudspeaker cabinet. Less commonly, the top and bottom are parallel. With this configuration, if the horns are stacked so that they are angled, as in FIG. 7, there is an undesirable gap 31 at the front of the array, between the top of one horn and the bottom of the horn above and an even wider gap between the bottom of one diffraction slot 14A and the top of the diffraction slot 14B of the horn loudspeaker underneath in the array.

Figure 8A:
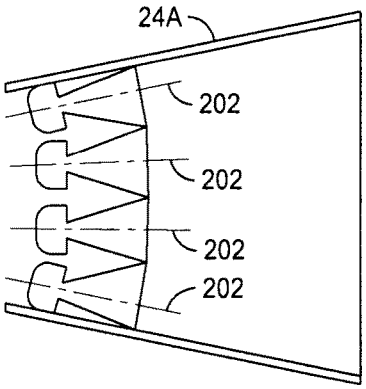
Figure 9:
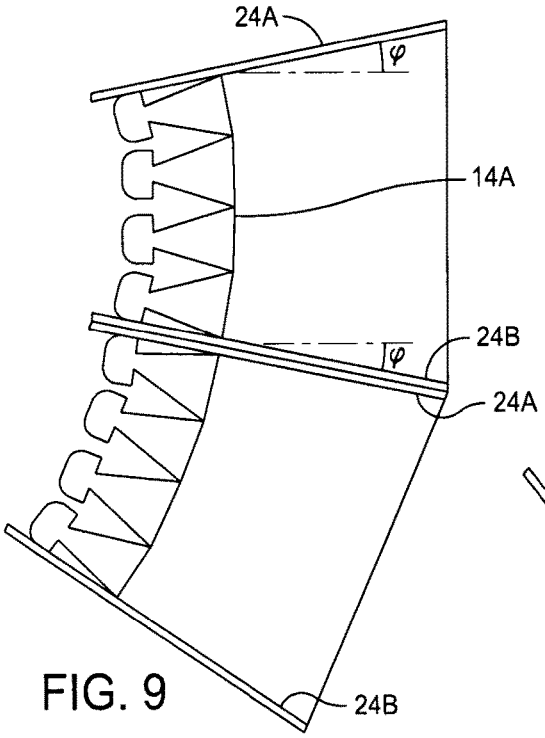
FIGS. 9 and 10 are diagrammatic side views of acoustic horn arrays.
Figure 10:
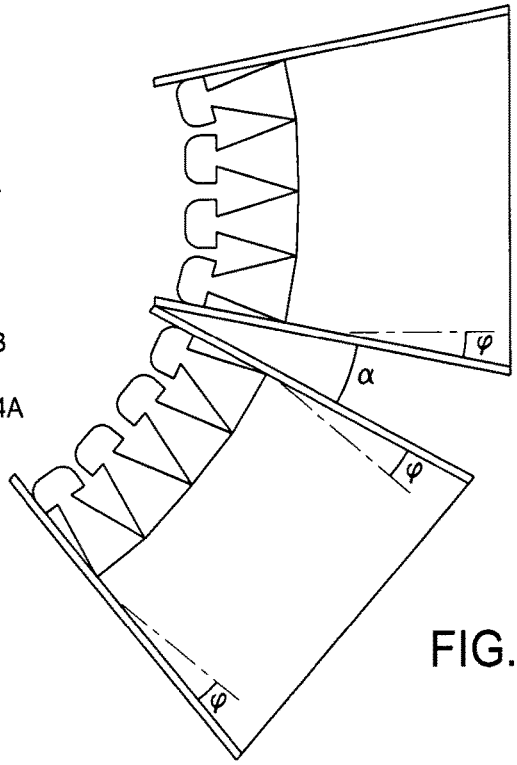

FIG. 8A shows another horn type loudspeaker arrangement in which the horn is configured so the acoustic paths from each acoustic driver to the combined diffraction slot are of equal length and so that centerlines 202 of the ducts are normal to an arc 204. Arranging the ducts so that the centerlines 202 are in an arc permits the he top wall 20A (of previous figures) and the bottom wall 20B (of previous figures) of the horn to coincide with the top 24A and bottom 24B of the enclosure; for convenience, the top and bottom of the horn and the top and bottom of the enclosure will both be referred to by reference numbers 24A and 24B. When two horn loudspeakers according to FIG. 8 are stacked, as in FIG. 9, the only significant gap in between the diffraction slots 14A and 14B is the thickness of the top wall of one horn loudspeaker and the bottom wall of the horn loudspeaker above. A typical thickness for the top wall and the bottom wall is 1.3 cm (0.5 inches) so that the gap is about 2.6 cm (1.0 inches). There may be other gaps equal to, for example, the thickness of the walls of the acoustic ducts 16 or of a manifold or of brackets or the like. The walls of acoustic ducts are typically about 3 mm (0.12 inches) thick, so the gaps are about 6 mm (0.24 inches). Gaps of less than an 1 cm generally do not affect the radiation pattern by a significant amount, so diffraction slot or diffraction slot section with gaps of less than 1 cm will be considered substantially continuous. To accommodate different horn loudspeaker array configurations, such as to form a "J" shaped horn array, with a continuous diffraction slot, it is desirable to have horn loudspeakers with a variety of vertical dispersion angles. For example, referring to FIG. 10, if it is desirable for the horns to be mounted at an angle $\alpha$ relative to each other, but the horns are only available with a vertical dispersion angle of $\varphi$, as in FIG. 9, an undesirable space between the horns and an undesirable gap in the diffraction slot will occur. Having horns with a variety of vertical dispersion angles permits the arrays to be formed without undesirable spaces between the horns and without undesirable gaps in the diffraction slot. For example, the angle $\varphi$ of FIG. 9 could be as small as five degrees or even zero degrees (so that the horn is rectangular when viewed from the side) or as large as thirty degrees or larger. The top and bottom may be flared at the same angle, so that the combined flare of the enclosure top 24A and bottom 24B is $2\varphi$ degrees. Since the top wall 20A (of previous figures) and the bottom wall 20B (of previous figures) of the horn are also the top 24A and bottom 24B of the enclosure, the combined flare of the top and bottom is the same as the vertical dispersion angle of the horn. Horns can be constructed so that any vertical dispersion can be provided, or the angle can be varied incrementally, for example in five or ten degree increments.

Figure 8B:
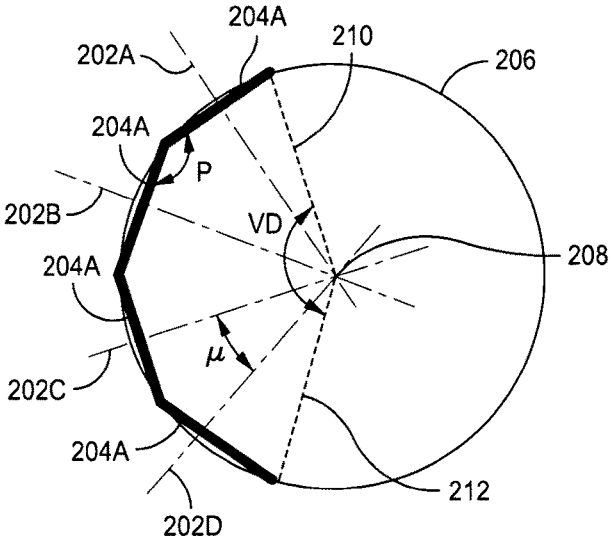
FIG. 8B is a diagram of geometric elements for explaining aspects of the acoustic horn of FIG. 8A.

FIG. 8B shows illustrates some features of the horn loudspeaker of FIG. 8A. Lines 204A-204D represent the ducts of four acoustic modules arranged to form a single continuous diffraction slot. Each of the ducts has a centerline 202A-202D, respectively. The centerlines are normal to an arc that is a portion of circle 206. The centerlines intersect at a point 208 at an angle $\mu$. Line 210 from intersection point 208 to one end of the diffraction slot and line 212 form the intersection point 208 to the other end of the diffraction slot intersect at angle VD, which is the vertical dispersion angle of the horn loudspeaker. For clarity of illustration, an acoustic horn with four acoustic modules is shown, and the vertical dispersion angle VD is much larger than a typical dispersion angle. Lines 204A-204D also represent the planes of the openings of the outlet ends of the acoustic ducts. The planes intersect at an angle P. Rearranging the ducts to change the vertical dispersion angle also causes the angle P to change.

Figure 11:
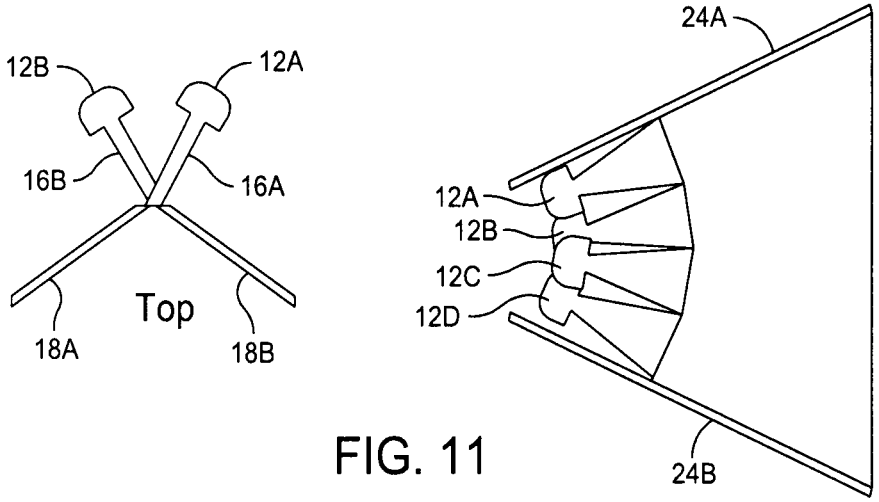
FIG. 11 includes a top and side diagrammatic views of an acoustic horn.

A difficulty with horn loudspeakers according to FIG. 8 with large vertical dispersion angles is that if the acoustic driver and acoustic duct assemblies are arranged so that the exits of the acoustic ducts are normal to an arc, the acoustic drivers and/or the acoustic ducts may overlap vertically. In that case, the acoustic ducts and the acoustic drivers may be displaced horizontally, as shown in FIG. 11. This allows the top and bottom walls 20A and 20B to coincide with the top and bottom walls 24A and 24B for larger vertical dispersion angles than are possible if the acoustic ducts and acoustic drivers are not displaced horizontally.

Figure 12:
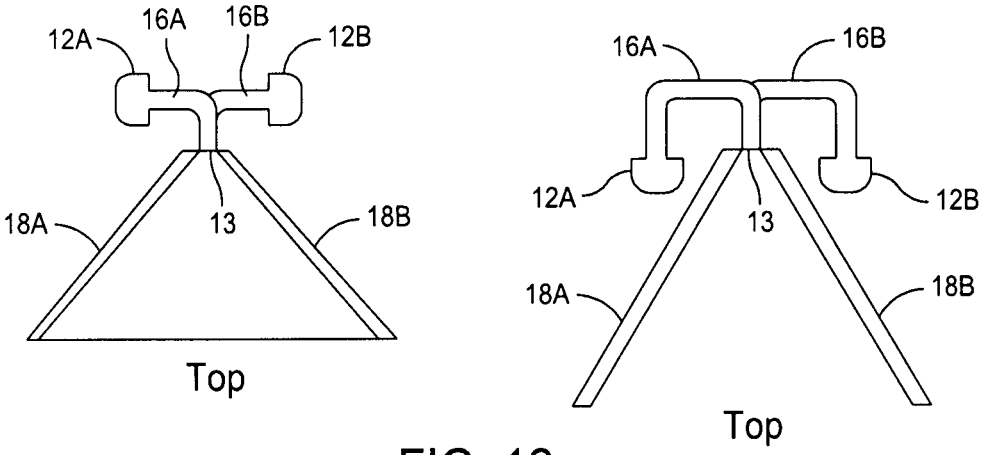
FIGS. 12 and 13 are top diagrammatic views of an acoustic horn.

Using straight acoustic ducts extending in the Y-direction may cause the horn loudspeaker to have more depth than is desired. In that case, the acoustic ducts may be curved, as shown in FIG. 12. In some implementations, the curve may extend so far that one or more of the acoustic drivers may be partially or wholly forward of the throat 13. In addition to decreasing the depth of the overall assembly, this has the advantage of moving the acoustic drivers to a location where there is more vertical room for them, allowing the use of drivers with larger outer diameters.

Figure 13:
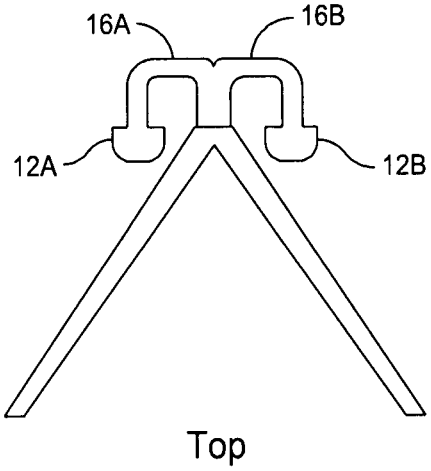

To provide more acoustic energy, more acoustic drivers can be added and the ducts merged at or before the horn throat. For example, FIG. 13 shows a horn loudspeaker in which two acoustic drivers 12A and 12B are acoustically coupled to acoustic ducts 16A and 16B, respectively. The outlet end of acoustic ducts are merged at a position between the acoustic drivers and the throat 13, so that combined acoustic energy radiated by acoustic drivers 12A and 12B is radiated into the horn through the diffraction slot in about the same vertical space that the acoustic energy from one acoustic driver is radiated into the horn through the diffraction slot in configurations such as FIG. 1.

The remainder of the figures show actual implementations of a horn loudspeaker incorporating elements of FIGS. 1-13. In the figures that follow, like reference numbers refer to corresponding elements in FIGS. 1-13.

Figure 14:
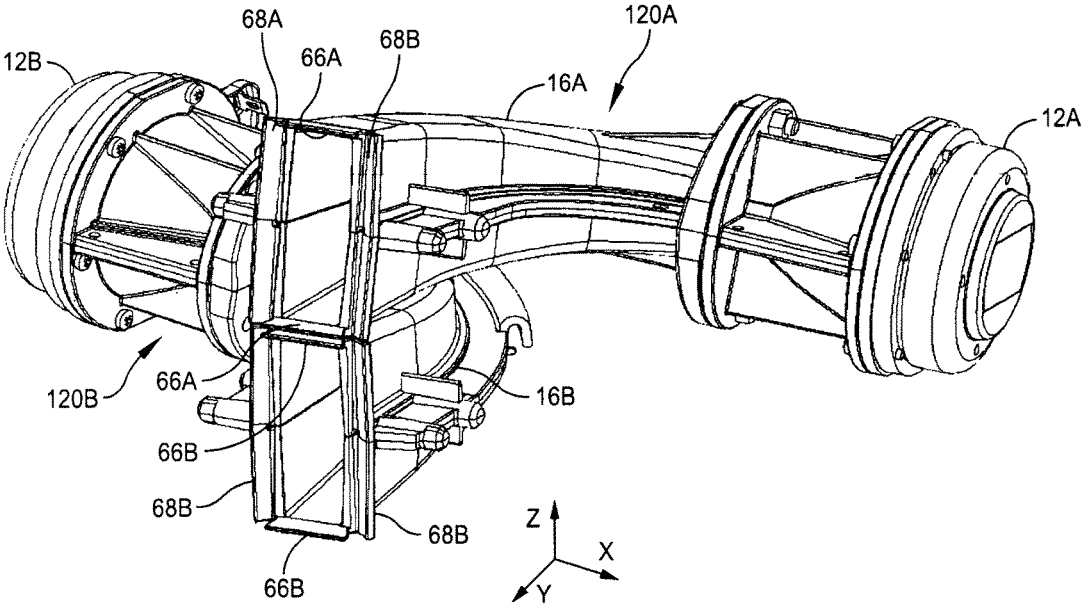
FIG. 14 is front oblique isometric view of an assembly including two acoustic modules.

FIG. 14 shows a first modular assembly 120A including an acoustic driver 12A and acoustic duct 16A and a second modular assembly 120B including an acoustic driver 12B and acoustic duct 16B. Modules 120A and 120B are asymmetric about the Y-Axis. The acoustic ducts are curved as in FIG. 12. The modular assembly 120B is substantially identical to the modular assembly 120A, but the second modular assembly 120B is rotated 180 degrees about the Y-axis relative to the orientation of modular assembly 120A. The opening at the outlet end of each of the ducts has a height of about 5.7 cm (2.25 inches) and a width of about 1.9 cm (0.75 inches).

The modular assemblies 120A and 120B are positioned so that the outlet ends are aligned in the direction of elongation and held in that position by attaching them to a mounting plate, or "keel", most clearly seen in FIGS. 16, 20, 21, and 23. The combined dimension in the direction of elongation of the outlet end openings is about 2×5.7 cm=11.4 cm. Additional modular assemblies can be similarly aligned to form an acoustic assembly that can be acoustically coupled to the throat of a horn to form a horn loudspeaker. In one implementation, six modular assemblies are aligned in the manner shown in FIG. 14, with the outlet ends arranged as in FIG. 8. The combined dimension in the direction of elongation is then about 6×5.7 cm=34.2 cm while the width remains about 1.9 cm. The six modular assemblies can be mechanically and acoustically coupled to the throat of an acoustic horn to form a horn loudspeaker. The combined outlet end openings operate as a diffraction slot for the acoustic horn. The outlet ends of the acoustic ducts 120A and 120B may have vertical flanges 68A and 68B to facilitate mating with the horn wall and may have horizontal flanges 66A and 66B to facilitate mating with other acoustic ducts to form a diffraction slot, as will be described below.

A modular assembly such as modular assemblies 120A and 120B is advantageous because it enables providing horn loudspeakers with a wide range of horizontal and vertical dispersion angles with many of the parts being standard. The assemblies 120A and 120B including the acoustic driver 12A and 12B, respectively, and the acoustic duct 16A and 16B, respectively, are standard, as are the top wall 24A and the bottom wall 24B, and the bass modules 80A and 80B of FIG. 24, including bass enclosures 82A and 82B (of FIG. 24) and woofer drivers 86 (of FIG. 24). Only side walls 18A and 18B, keel 56 (most clearly seen in FIGS. 16, 20, 21, and 23) and side bracket 57 (of FIG. 24) vary from horn to horn.

Figure 15:
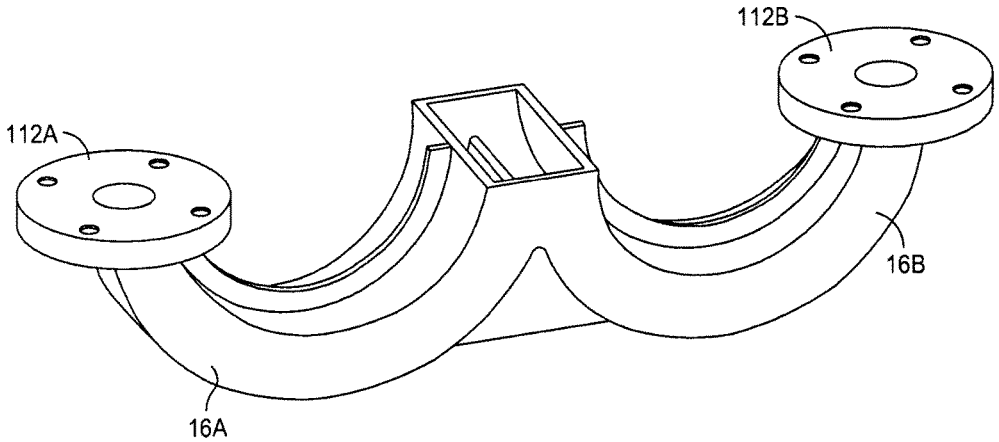
FIG. 15 is an oblique isometric view of an acoustic module.

FIG. 15 shows a modular assembly with mounting plates 112A and 112B, for two acoustic drivers (not shown in this view) in a configuration similar to the acoustic duct of FIG. 13. Modular assemblies such as shown in FIG. 15 can be positioned in the same manner as modular assemblies 120A and 120B of FIG. 14.

Figure 17:
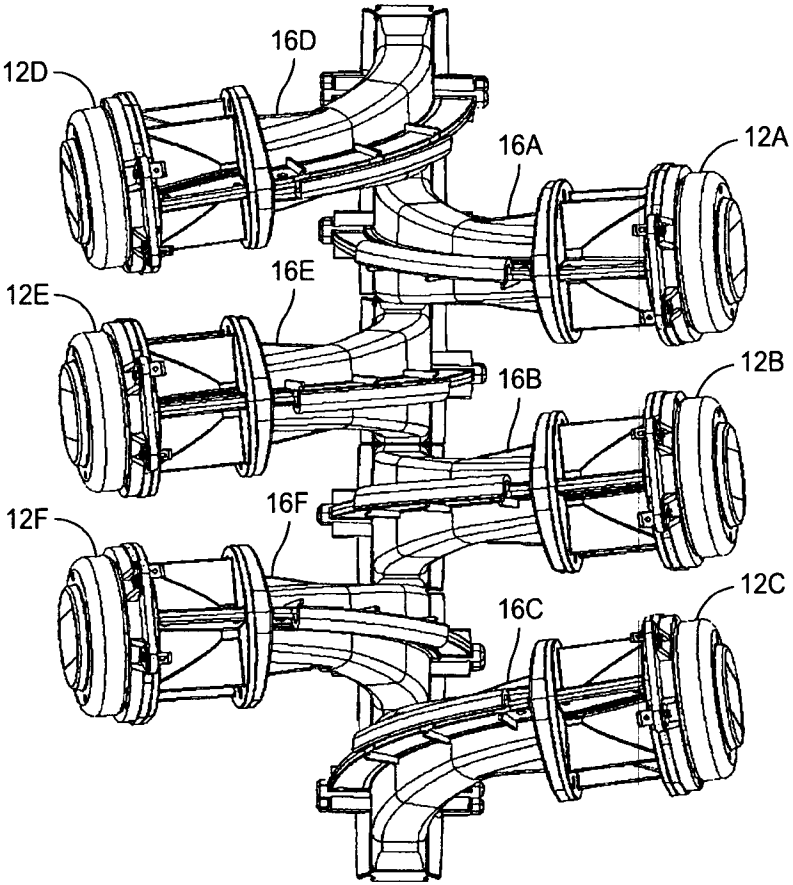
FIG. 17 is a back plan view of an assembly including six acoustic drivers and six acoustic ducts.
Figure 16:
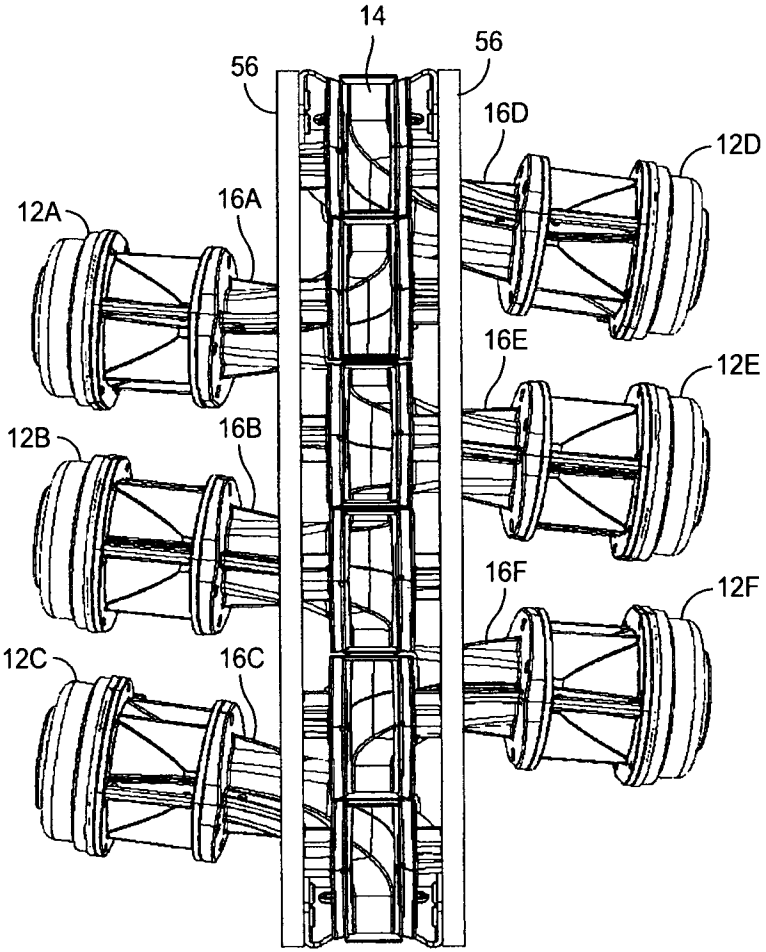
FIG. 16 is a front plan view of an assembly including six acoustic drivers and six acoustic ducts.

FIGS. 16 and 17, show a front view and a rear view, respectively, of an assembly of six acoustic drivers 12A-12F and six acoustic ducts 16A-16F. The outlets of the acoustic ducts 16A-16F are aligned to form the diffraction slot 14. The acoustic ducts are positioned by, and held in place by, the keel 56. The keel 56 orients the outlets of the acoustic ducts normal to an arc and holds the acoustic modules in the desired position and orientation. Gaskets (not identified in this view) may be placed between the lower edge of one acoustic duct and the top edge of the acoustic duct below to prevent airflow leakage or airflow disturbances.

Figure 18C:
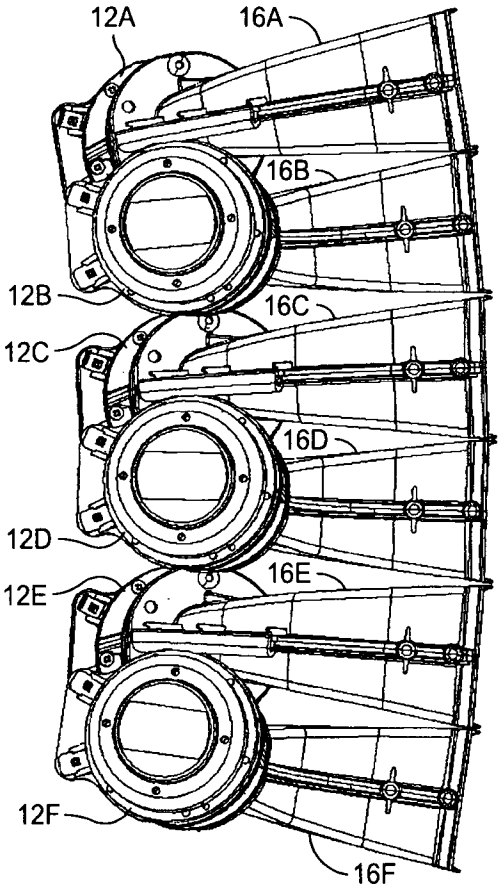
FIG. 18A-18E are side plan views of an assembly including six acoustic modules.
Figure 18B:
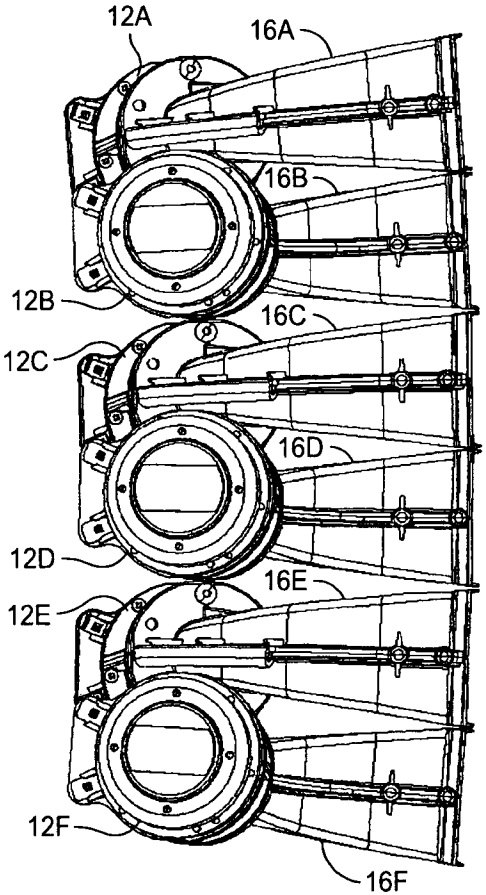
Figure 18A:
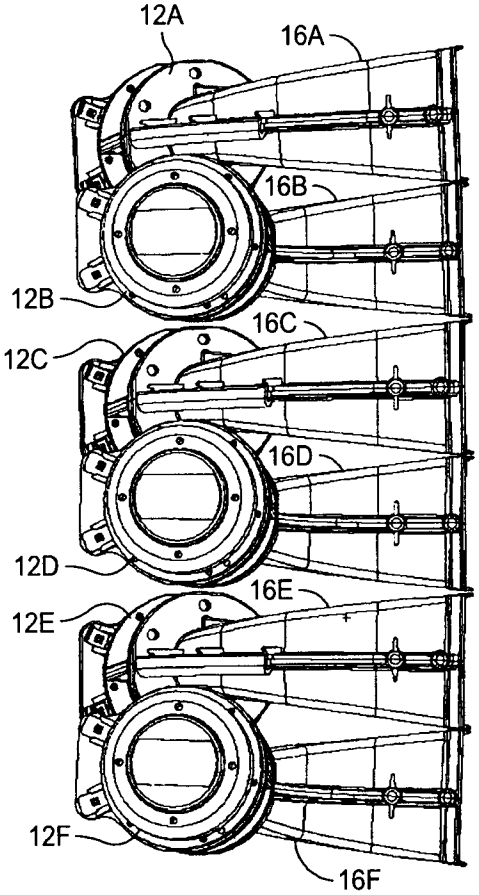
Figure 18E:
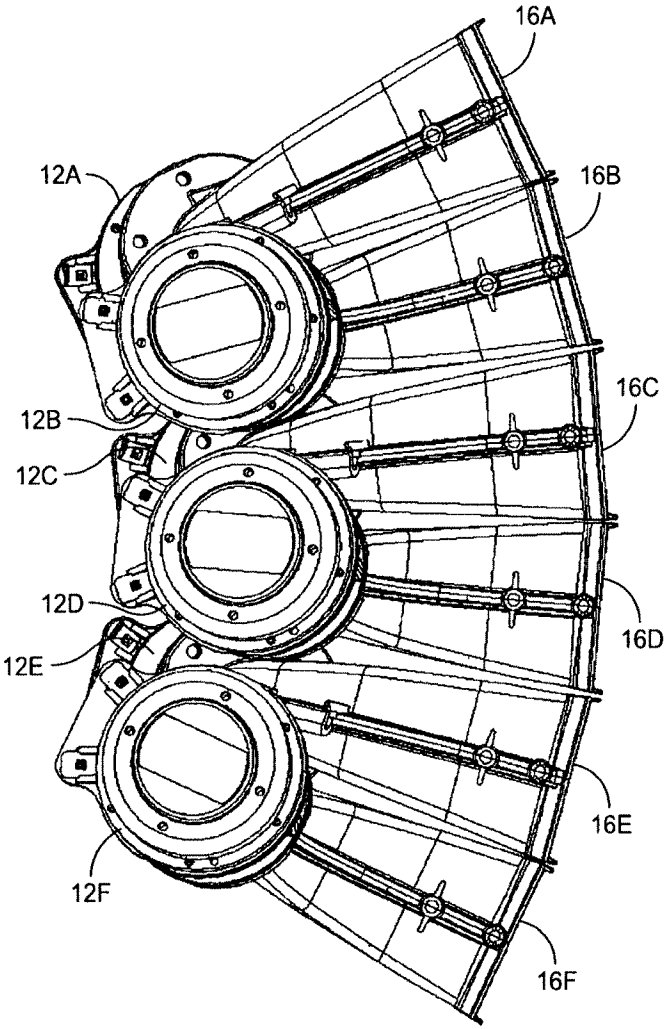
Figure 18D:
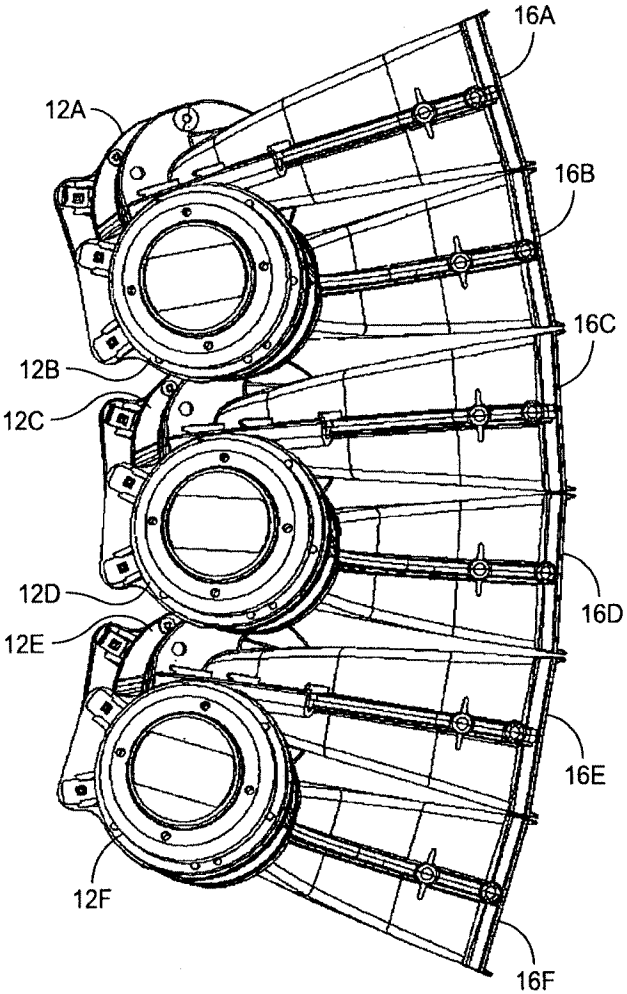

FIGS. 18A-18E show side views of six modular assemblies 120A-120F positioned to form an acoustic assembly 150 to mate with the throat of a horn to form a horn loudspeaker. FIG. 18A shows the orientation of the acoustic drivers and acoustic ducts assemblies with a vertical dispersion angle of five degrees; the curve of the arc is barely perceptible and there is moderate vertical overlap between the acoustic drivers 12A-12F. FIGS. 18B-18E show the orientation of the acoustic driver and acoustic duct assemblies with vertical dispersion angles of 10 degrees, 20 degrees, 40 degrees, and 60 degrees, respectively. The curve of the arc becomes more pronounced and there is significant vertical overlap between the acoustic drivers 14A-14F.

Figure 19B:
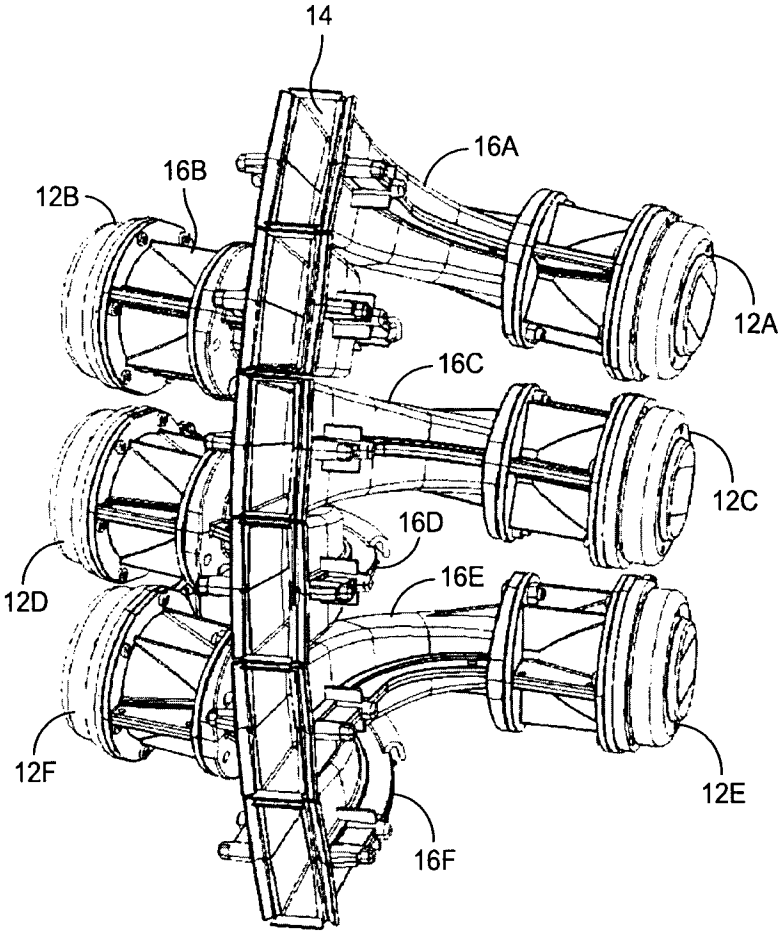
FIGS. 19A and 19B are oblique isometric views of an assembly including six acoustic modules.
Figure 19A:
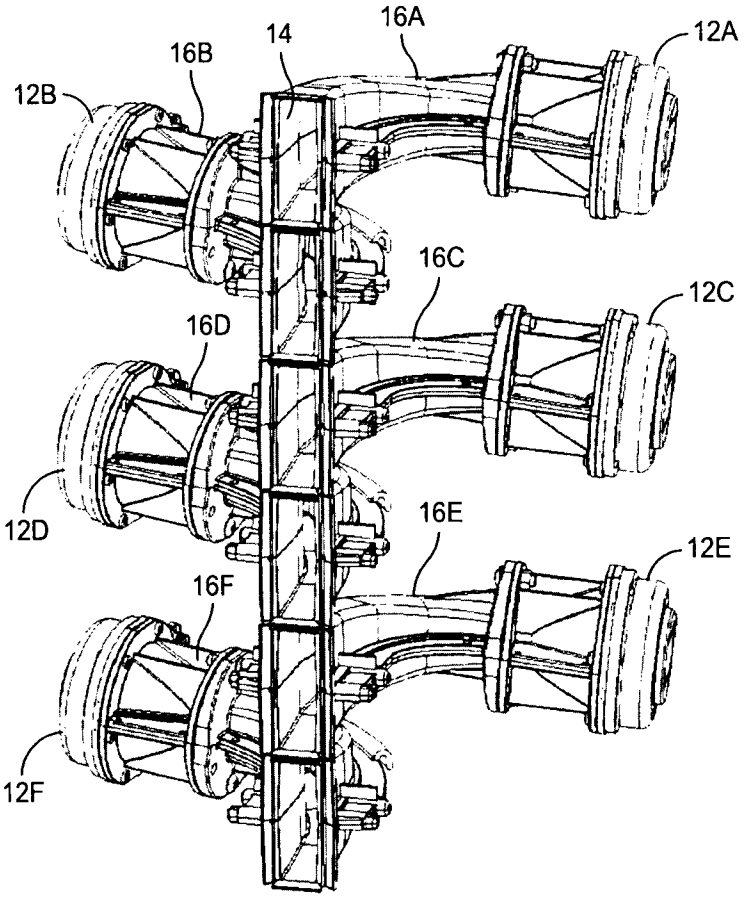

FIGS. 19A and 19B show front oblique isometric views of an acoustic assembly similar to the acoustic assemblies of FIGS. 18A-18E, with vertical dispersion angles of 5 degrees and 60 degrees, respectively. FIGS. 19A and 19B show how the openings at the outlet end of the acoustic ducts are aligned to form an arcuate diffraction slot 14. In FIG. 19A, the arc is barely perceptible, while in FIG. 19B, the arc is more pronounced.

Figure 21:
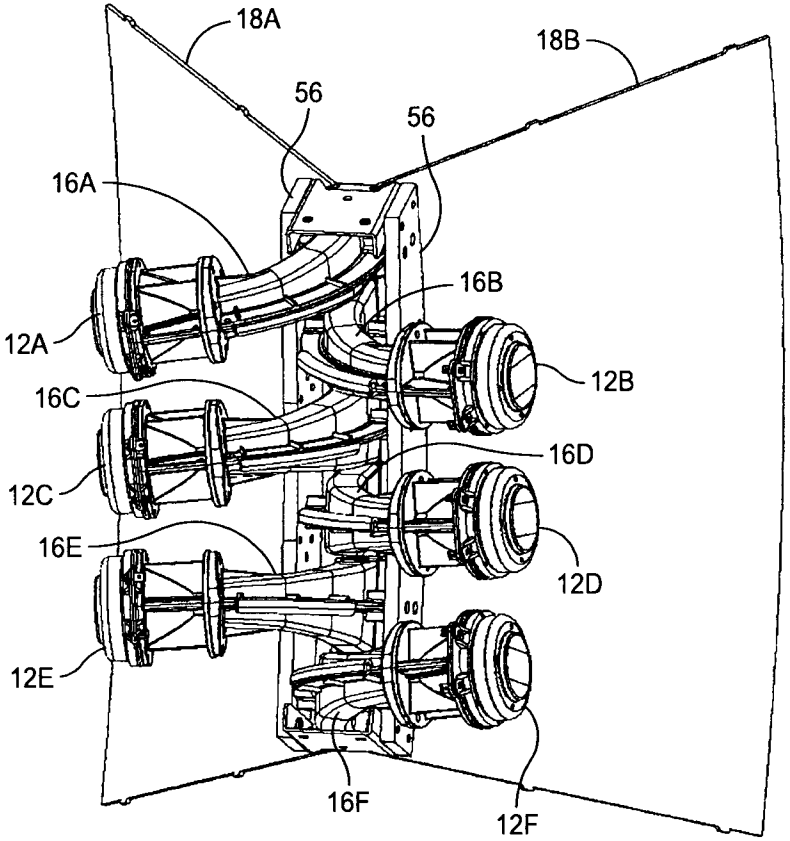
FIG. 21 is a back oblique isometric view of an assembly including six acoustic modules and horn side walls.
Figure 20:
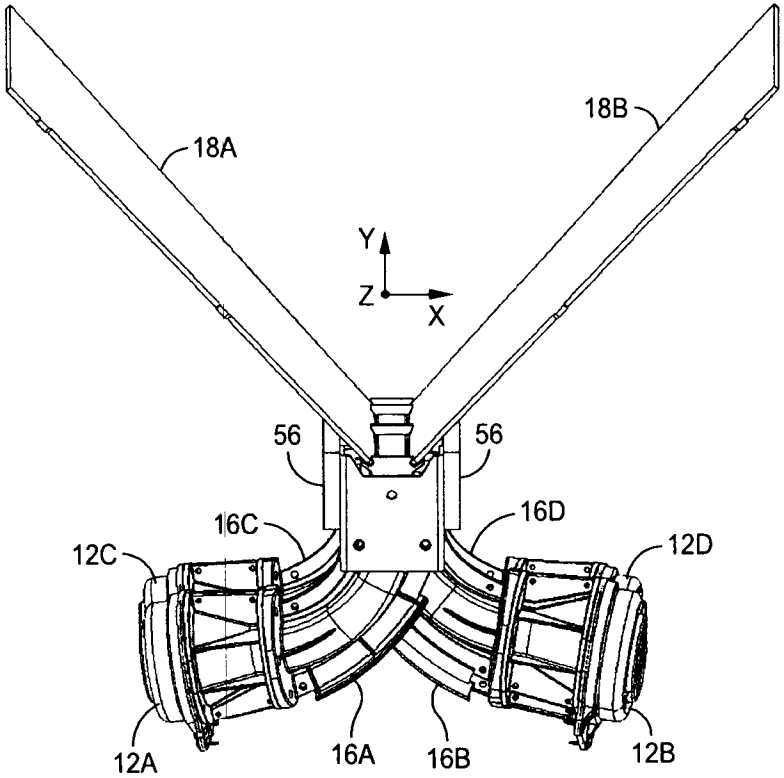
FIG. 20 is a top plan view of an assembly including six acoustic modules and horn side walls.

FIGS. 20 and 21 show a top view and an oblique back isometric view, respectively, of an acoustic driver and acoustic duct assembly according to FIGS. 19A and 19B, with the horn side walls 18A and 18B. In this assembly, he horn side walls 18A and 18B are not planar and have some curvature, so a portion of the surface of the side walls is visible in the top view of FIG. 19A. To show the side walls 18A and 18B, the top and bottom walls are omitted from this view. In the figures, the side walls 18A and 18B are shown as flaring symmetrically in the X-Y plane. In some implementations, the side walls may flare asymmetrically in the X-Y plane. Some of the acoustic drivers and some of the acoustic ducts are not visible in FIG. 20.

Figure 22:
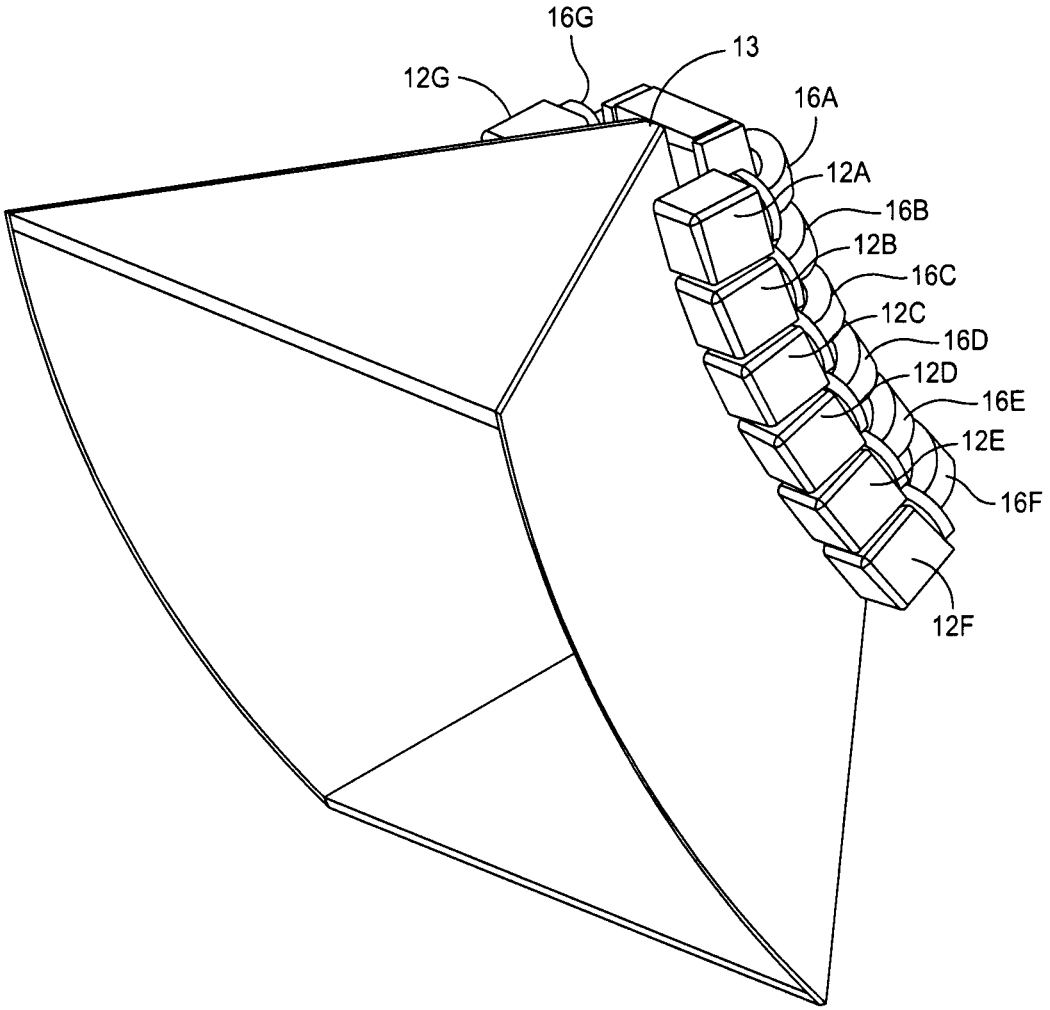
FIG. 22 is an oblique isometric view of an acoustic horn.

FIG. 22 shows an assembly including twelve acoustic drivers. In this view, six acoustic drivers 12A-12F are visible, a seventh acoustic driver 12G is partially obscured and the remaining five acoustic drivers are hidden in this view. In the implementation of FIG. 22, the twelve acoustic drivers are arranged in six pairs. Each pair of acoustic drivers are acoustically coupled to an acoustic duct 16A-16F according to FIGS. 13 and 15. A portion of each of the acoustic drivers (for example acoustic driver 12A) is forward of the diffraction slot which is positioned at the throat 13 of the horn. The horn of FIG. 22 is formed according to U.S. patent application Ser. No. 12/557,885. A similar acoustic driver and acoustic duct arrangement can be implemented with a horn according to this specification.

Figure 23:
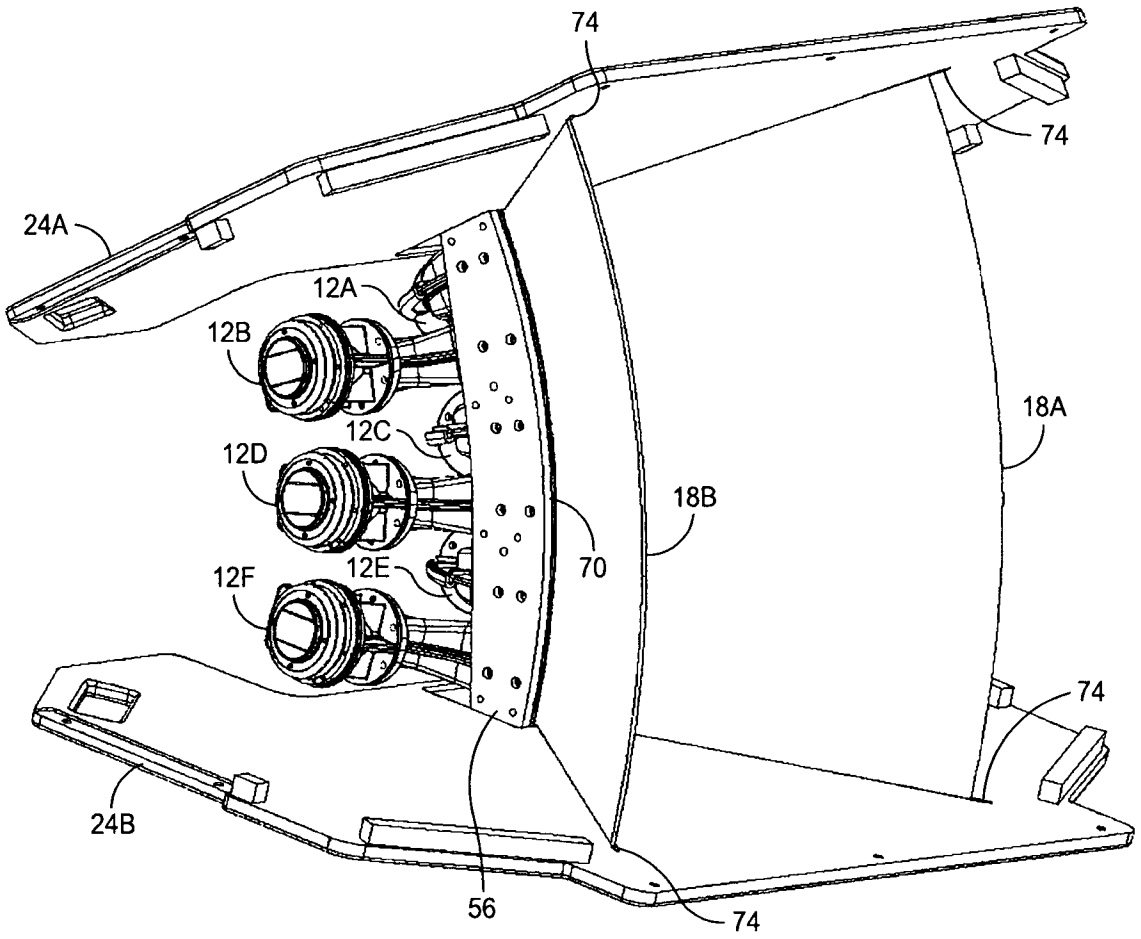
FIG. 23 is an oblique isometric view of an assembly including some elements of an acoustic horn.

FIG. 23 shows an oblique isometric front view of the assembly of FIGS. 20 and 21 with the top and bottom enclosure walls 24A and 24B (which, as described above in the discussion of FIG. 8 also are the top and bottom horn walls) angled to provide a 40 degree vertical dispersion angle. In FIG. 23, the curve of the front edge 70 of the keel 56 is visible. The top wall 24A and the bottom wall 24B may be mechanically fastened to the ends of keel 56. The enclosure 22 has no sides or back, and the same parts can be used for the top wall 24A and bottom wall 24B regardless of the vertical dispersion angle. The horn side walls 18A and 18B may be held in place by mechanical fastening to the keel 56 and by inserting the top and bottom edges of the side walls into slots 74 in the top and bottom 24A and 24B.

Figure 24:
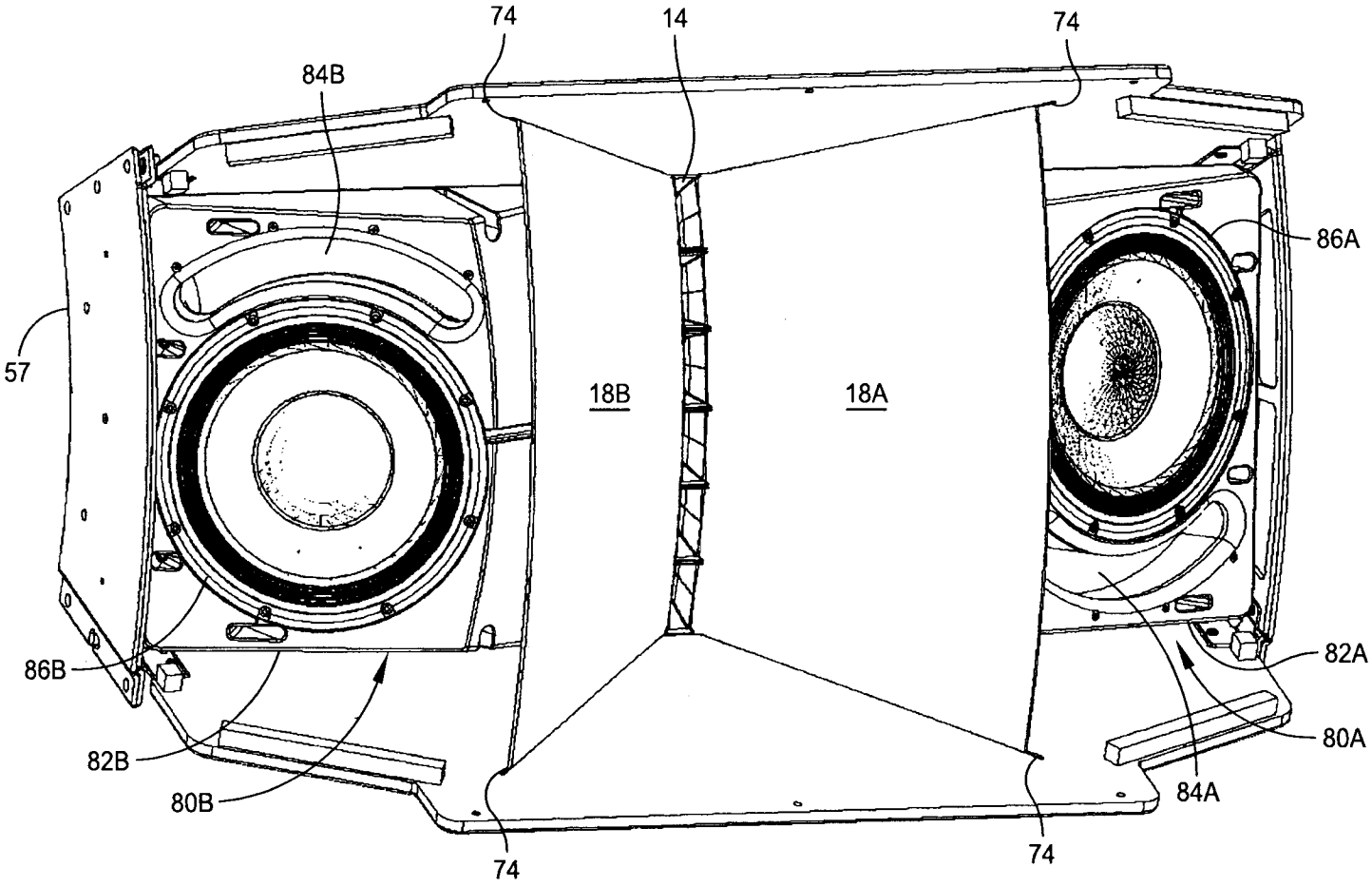
FIG. 24 is an oblique isometric view of and assembly including some elements of an acoustic horn.

FIG. 24 shows the assembly of FIG. 23 with bass modules 80A and 80B. Bass modules 80A and 80B may includes a 25.4 cm (10 inch) nominal woofer driver 86 mounted in a bass enclosure 82 with a port 84. The bass modules may be mechanically fastened to a side bracket 57 which may be mechanically fastened to the top wall 24A and bottom wall 24B. The assembly of FIG. 23 enables providing horn loudspeakers with a wide range of vertical dispersion angle and horizontal dispersion angles with many parts that are standard for all vertical and horizontal dispersion angles and with a minimum of variation in the manufacturing process. For example, the top wall 24A, the bottom wall 24B, the acoustic drivers, acoustic ducts and the bass module may all be standard. Only the keel 56, the side bracket 57, and the horn side walls 18A and 18B need to be varied to vary the vertical dispersion angle. The horizontal dispersion angle can be varied by varying the orientation of the slots 74. The assembly process for all horn loudspeakers, regardless of vertical or horizontal dispersion angle, is substantially identical.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A loudspeaker comprising:

a horn comprising a first end panel, a second end panel, a first side wall, and a second side wall, edges of at least the first and second side walls defining a diffraction slot opening; and a plurality of electro-acoustic transducers configured to be coupled to the diffraction slot opening, wherein the horn has configurable vertical and horizontal dispersion angles, wherein the vertical angle is determined by a curvature of the diffraction slot opening and the horizontal angle is determined by an angle of the side walls from the diffraction slot opening; and wherein the plurality of electro-acoustic transducers are coupled to the diffraction slot opening via a plurality of manifold components, each manifold component comprising at least one acoustic passage and an output opening coupled to the diffraction slot opening, the output openings of the plurality of manifold components together constituting a diffraction slot source at the diffraction slot opening, and wherein each electro-acoustic transducer is coupled to an input opening of one of the manifold components.

2. The loudspeaker of claim 1, wherein each manifold component comprises two acoustic passages and two input openings, each of the acoustic passages having a first end at a different one of the two input openings and a second end at the output opening, and wherein the acoustic passages each curve away from the output opening in different directions, such that the two input openings are located near opposite sides of the horn.

3. The loudspeaker of claim 1, wherein each manifold component comprises one input opening and one acoustic passage having a first end at the input opening and a second end at the output opening, wherein the acoustic passage of each manifold component curves away from the output opening in a direction opposite that of a neighboring manifold components' acoustic passages, such that the input opening is located near an opposite side of the horn from the neighboring manifold components' input openings.

4. The loudspeaker of claim 1, wherein at least one of the first and second end panels is asymmetric about at least one axis.

5. The loudspeaker of claim 1, wherein at least one of a depth and width of the horn varies along a height of the horn.

6. The loudspeaker of claim 1, wherein varying the curvature of a diffraction slot opening along a length of the diffraction slot opening results in a vertical dispersion angle for the horn that varies along the length of the diffraction slot opening.

7. A loudspeaker comprising:

a horn comprising a first end panel, a second end panel, a first side wall, and a second side wall, edges of at least the first and second side walls defining a diffraction slot opening; and a plurality of electro-acoustic transducers configured to be coupled to the diffraction slot opening, wherein the side walls of the horn vary in at least one of length, width, curvature and placement angle; and wherein the plurality of electro-acoustic transducers are coupled to the diffraction slot opening via a plurality of manifold components, each manifold component comprising at least one acoustic passage and an output opening coupled to the diffraction slot opening, the output openings of the plurality of manifold components together constituting a diffraction slot source at the diffraction slot opening, and wherein each electro-acoustic transducer is coupled to an input opening of one of the manifold components.

8. The loudspeaker of claim 7, wherein each manifold component comprises two acoustic passages and two input openings, each of the acoustic passages having a first end at a different one of the two input openings and a second end at the output opening, and wherein the acoustic passages each curve away from the output opening in different directions, such that the two input openings are located near opposite sides of the horn.

9. The loudspeaker of claim 7, wherein each manifold component comprises one input opening and one acoustic passage having a first end at the input opening and a second end at the output opening, wherein the acoustic passage of each manifold component curves away from the output opening in a direction opposite that of a neighboring manifold components' acoustic passages, such that the input opening is located near an opposite side of the horn from the neighboring manifold components' input openings.

10. The loudspeaker of claim 7, wherein at least one of the first and second end panels is asymmetric about at least one axis.

11. The loudspeaker of claim 7, wherein at least one of a depth and width of the horn varies along a height of the horn.

12. The loudspeaker of claim 7, wherein varying the curvature of a diffraction slot opening along a length of the diffraction slot opening results in a vertical dispersion angle for the horn that varies along the length of the diffraction slot opening.

13. A loudspeaker comprising:

a horn comprising a first end panel, a second end panel, a first side wall, and a second side wall, edges of at least the first and second side walls defining a diffraction slot opening; and a plurality of electro-acoustic transducers configured to be coupled to the diffraction slot opening, wherein the horn has a shape that is asymmetric about at least one axis; and wherein the plurality of electro-acoustic transducers are coupled to the diffraction slot opening via a plurality of manifold components, each manifold component comprising at least one acoustic passage and an output opening coupled to the diffraction slot opening, the output openings of the plurality of manifold components together constituting a diffraction slot source at the diffraction slot opening, and wherein each electro-acoustic transducer is coupled to an input opening of one of the manifold components.

14. The loudspeaker of claim 13, wherein each manifold component comprises two acoustic passages and two input openings, each of the acoustic passages having a first end at a different one of the two input openings and a second end at the output opening, and wherein the acoustic passages each curve away from the output opening in different directions, such that the two input openings are located near opposite sides of the horn.

15. The loudspeaker of claim 13, wherein each manifold component comprises one input opening and one acoustic passage having a first end at the input opening and a second end at the output opening, wherein the acoustic passage of each manifold component curves away from the output opening in a direction opposite that of a neighboring manifold components' acoustic passages, such that the input opening is located near an opposite side of the horn from the neighboring manifold components' input openings.

16. The loudspeaker of claim 13, wherein at least one of the first and second end panels is asymmetric about at least one axis.

17. The loudspeaker of claim 13, wherein at least one of a depth and width of the horn varies along a height of the horn.

18. The loudspeaker of claim 13, wherein varying the curvature of a diffraction slot opening along a length of the diffraction slot opening results in a vertical dispersion angle for the horn that varies along the length of the diffraction slot opening.

19. A loudspeaker comprising:

a horn comprising a first end panel, a second end panel, a first side wall, and a second side wall, edges of at least the first and second side walls defining a diffraction slot opening; and a plurality of electro-acoustic transducers configured to be coupled to the diffraction slot opening, wherein the diffraction slot opening is placed off-center between the side walls of the horn results in an asymmetric horizontal dispersion angle; and wherein the plurality of electro-acoustic transducers are coupled to the diffraction slot opening via a plurality of manifold components, each manifold component comprising at least one acoustic passage and an output opening coupled to the diffraction slot opening, the output openings of the plurality of manifold components together constituting a diffraction slot source at the diffraction slot opening, and wherein each electro-acoustic transducer is coupled to an input opening of one of the manifold components.

20. The loudspeaker of claim 19, wherein each manifold component comprises two acoustic passages and two input openings, each of the acoustic passages having a first end at a different one of the two input openings and a second end at the output opening, and wherein the acoustic passages each curve away from the output opening in different directions, such that the two input openings are located near opposite sides of the horn.

21. The loudspeaker of claim 19, wherein each manifold component comprises one input opening and one acoustic passage having a first end at the input opening and a second end at the output opening, wherein the acoustic passage of each manifold component curves away from the output opening in a direction opposite that of a neighboring manifold components' acoustic passages, such that the input opening is located near an opposite side of the horn from the neighboring manifold components' input openings.

22. The loudspeaker of claim 19, wherein at least one of the first and second end panels is asymmetric about at least one axis.

23. The loudspeaker of claim 19, wherein at least one of a depth and width of the horn varies along a height of the horn.

24. The loudspeaker of claim 19, wherein varying the curvature of a diffraction slot opening along a length of the diffraction slot opening results in a vertical dispersion angle for the horn that varies along the length of the diffraction slot opening.

* * * * *